US007546695B2

(12) United States Patent
Aveni et al.

(10) Patent No.: US 7,546,695 B2
(45) Date of Patent: Jun. 16, 2009

(54) FOOT-SUPPORT STRUCTURES WITH ADDITIONAL SHEAR SUPPORT AND PRODUCTS CONTAINING SUCH SUPPORT STRUCTURES

(75) Inventors: Michael Aveni, Lake Oswego, OR (US); William J. Cass, Portland, OR (US); Anthony C. Dean, Sherwood, OR (US); Fred G. Fagergren, Hillsboro, OR (US); Kurt Joseph Stockbridge, Lake Oswego, OR (US); Randall Wyszynski, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 608 days.

(21) Appl. No.: 11/065,296

(22) Filed: Feb. 25, 2005

(65) Prior Publication Data

US 2006/0191162 A1 Aug. 31, 2006

(51) Int. Cl.
*A43B 13/18* (2006.01)
*A61F 5/14* (2006.01)

(52) U.S. Cl. ..... 36/28; 36/30 R; 36/114; 36/140; 36/88; D2/964

(58) Field of Classification Search ..... 36/28, 36/35 R, 25 R, 88, 150, 140, 145, 146; D2/964
See application file for complete search history.

(56) References Cited

U.S. PATENT DOCUMENTS

| | | | | |
|---|---|---|---|---|
| 3,886,674 A | | 6/1975 | Pavia | |
| 4,402,146 A | * | 9/1983 | Parracho et al. | 36/129 |
| 4,484,397 A | * | 11/1984 | Curley, Jr. | 36/92 |
| 4,492,046 A | * | 1/1985 | Kosova | 36/27 |
| 5,224,810 A | * | 7/1993 | Pitkin | 36/30 R |
| 5,279,051 A | | 1/1994 | Whatley | |
| 5,297,349 A | * | 3/1994 | Kilgore | 36/114 |
| 5,317,820 A | * | 6/1994 | Bell et al. | 36/89 |
| 5,465,509 A | * | 11/1995 | Fuerst et al. | 36/88 |
| 5,852,887 A | * | 12/1998 | Healy et al. | 36/88 |
| 6,023,859 A | * | 2/2000 | Burke et al. | 36/105 |
| 6,115,943 A | | 9/2000 | Gyr | |
| 6,327,795 B1 | * | 12/2001 | Russell | 36/28 |
| 6,457,261 B1 | | 10/2002 | Crary | |

FOREIGN PATENT DOCUMENTS

| | | | |
|---|---|---|---|
| WO | 03043455 | A1 | 5/2003 |
| WO | 2006009866 | A1 | 1/2006 |
| WO | 2006057764 | A1 | 6/2006 |

OTHER PUBLICATIONS

International Search Report dated Jun. 20, 2006.

* cited by examiner

*Primary Examiner*—Jila M Mohandesi
(74) *Attorney, Agent, or Firm*—Banner & Witcoff, Ltd

(57) ABSTRACT

Support elements for footwear or other products include: (a) a base member having first and second major surfaces; and (b) an extending arm having a free end for engaging a portion of a footwear structure. The extending arm may engage and further support a heel-supporting portion or other structural portion of an article of footwear or other foot-receiving device. Such foot-receiving devices may include: (a) a foot-covering member (such as a footwear upper); (b) a foot-supporting member (such as a footwear sole structure) engaged with the foot-covering member; and (c) a lateral-reinforcing member that includes an extending arm engaged with at least one of the foot-covering member or the foot-supporting member.

16 Claims, 6 Drawing Sheets

FOOT-SUPPORT STRUCTURES WITH ADDITIONAL SHEAR SUPPORT AND PRODUCTS CONTAINING SUCH SUPPORT STRUCTURES

FIELD OF THE INVENTION

The invention relates generally to support elements useful in articles of footwear and other foot-receiving device products. Such support elements may help prevent lateral or shear movement of one portion of the foot-receiving device product with respect to other portions of the product. Footwear products equipped with shear support elements in accordance with some examples of this invention, e.g., in the sole structure or other foot-supporting structure, may provide more solid feel, particularly when cutting or in other rapid direction change situations.

BACKGROUND

Conventional articles of footwear, e.g., like the athletic footwear structure 100 shown in FIG. 1, have included two primary elements, namely an upper member 102 and a sole member or structure 104. The upper member 102 and the sole member 104, at least in part, define a foot-receiving chamber that may be accessed through opening 106. The upper member 102 provides a covering for the foot that securely receives and positions the foot with respect to the sole structure 104. In addition, the upper member 102 may have a configuration that protects the foot and provides ventilation, thereby cooling the foot and removing perspiration. The sole structure 104 generally is secured to a lower portion of the upper member 102 and generally is positioned between the foot and the ground (the term "ground," as used herein, includes any foot or footwear contact surface, including but not limited to: grass, dirt, snow, ice, tile, flooring, carpeting, synthetic grass, and the like). In addition to attenuating ground reaction forces, the sole structure 104 may provide traction and help control foot motion, such as pronation. Accordingly, the upper member 102 and the sole structure 104 operate cooperatively to provide a comfortable structure that is suited for a variety of ambulatory activities, such as walking and running.

The sole member or structure 104 of athletic footwear, in at least some instances, will exhibit a layered configuration that includes a comfort-enhancing insole (not shown in FIG. 1), a resilient midsole 108 (e.g., formed, at least in part, from a polymer foam material), and a ground-contacting outsole 110 that provides both abrasion-resistance and traction. The midsole 108, in at least some instances, will be the primary sole structure element that attenuates ground reaction forces and controls foot motion. Suitable polymer foam materials for at least portions of the midsole 108 include ethylvinylacetate ("EVA") or polyurethane ("PU") that compress resiliently under an applied load to attenuate ground reaction forces. Conventional polymer foam materials are resiliently compressible, in part, due to the inclusion of a plurality of open or closed cells that define an inner volume substantially displaced by gas. In some example structures, as shown in FIG. 1, the midsole 108 may be of an open structure, such that columns of impact-attenuating elements 108*a* are exposed and visible in the final footwear product structure 100. Indeed, in this illustrated structure 100, one can see completely through the midsole structure 108 to the opposite side of the footwear structure 100 and beyond.

The upper member 102 and sole structure 104 in conventional footwear products are joined to one another in various different ways, such as using cements or adhesives, stitching or sewing, mechanical connectors, fusing techniques, or the like. While such conventional connection processes are sufficient in many shoe constructions, some users or specific uses potentially could benefit from added support provided between the sole structure 104 and other portions of the footwear product 100. For example, some footwear users participate in events or exercise programs that require frequent direction changes, often at high speeds. Such direction changes typically require the athlete to solidly plant and then push off one foot in a sideways direction, at times with some amount of twisting or spinning action. These lateral movements and actions tend to place substantial sheer stress on the footwear structure 100, particularly at the junction between the upper member 102 and the sole structure 104 and/or between various individual parts of the sole structure 104.

Conventional footwear structures 100 of the type illustrated in FIG. 1 include a tail or loop member 112 extending from a bottom mounting plate 114 to a heel portion 116 of the midsole structure 108. This heel portion 116 may constitute a structural support plate, such as a plastic support plate. The tail or loop member 112 may be formed from the same material(s) that make up the mounting plate 114, the outsole 110, and/or the midsole 108. This tail or loop member 112 enhances the midsole's resistance to shear forces (e.g., helps prevent columns 108*a* from toppling over under shear or lateral stresses) while not making the midsole 108 excessively stiff and/or otherwise adversely influencing its impact-attenuating characteristics. While effective in enhancing shear resistance, some designers and consumers do not favor the appearance of this additional tail or loop member 112.

Accordingly, it would be useful to provide a sole structure and/or a support element for use in a sole structure, e.g., for an article of footwear or other foot-receiving device product, that provides additional lateral support for the foot against shear forces (e.g., during a cutting or direction change action) and favorably impacts the structural integrity of the foot-receiving device product, e.g., at the sole structure/upper member interface and/or at an interface between various portions of the sole structure.

SUMMARY

The following presents a general summary of aspects of this invention in order to provide a basic understanding of at least some aspects of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to support elements for footwear or other foot-receiving device products. Such support elements may include: (a) a base member including a first major surface and a second major surface opposite the first major surface; and (b) an arm extending from the base member, wherein a free end of the arm includes a footwear-engaging region for engaging a portion of a footwear structure, such as a portion of the footwear upper or sole structure.

Another example aspect of this invention relates to foot-supporting members that include: (a) a heel-supporting member; (b) an impact-attenuating member engaged with the heel-supporting member; and (c) a lateral-reinforcing member engaged with the impact-attenuating member, wherein the lateral-reinforcing member includes an extending arm that engages the heel-supporting member. The extending arm of the lateral-reinforcing member may pass through an opening provided in a base of the impact-attenuating member. Foot-supporting members of this type may form at least a portion of a sole structure for an article of footwear. The heel-supporting member may constitute a portion of the upper member and/or the sole structure of the article of footwear.

Still additional example aspects of this invention relate to foot-receiving devices, such as articles of footwear. Such devices may include, for example: (a) a foot-covering member (such as a footwear upper member or a portion thereof); (b) a foot-supporting member (such as a footwear sole structure or a portion thereof) engaged with the foot-covering member, wherein the foot-supporting member, at least in part, attenuates impact reaction forces; and (c) a lateral-reinforcing member, wherein the lateral-reinforcing member includes an extending arm that engages at least one of the foot-covering member or the foot-supporting member. The extending arm of the lateral-reinforcing member may pass through an opening provided in a portion of the foot-supporting member, and/or it may be integrally formed as a unitary one-piece construction with a portion of the foot-supporting member.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1:
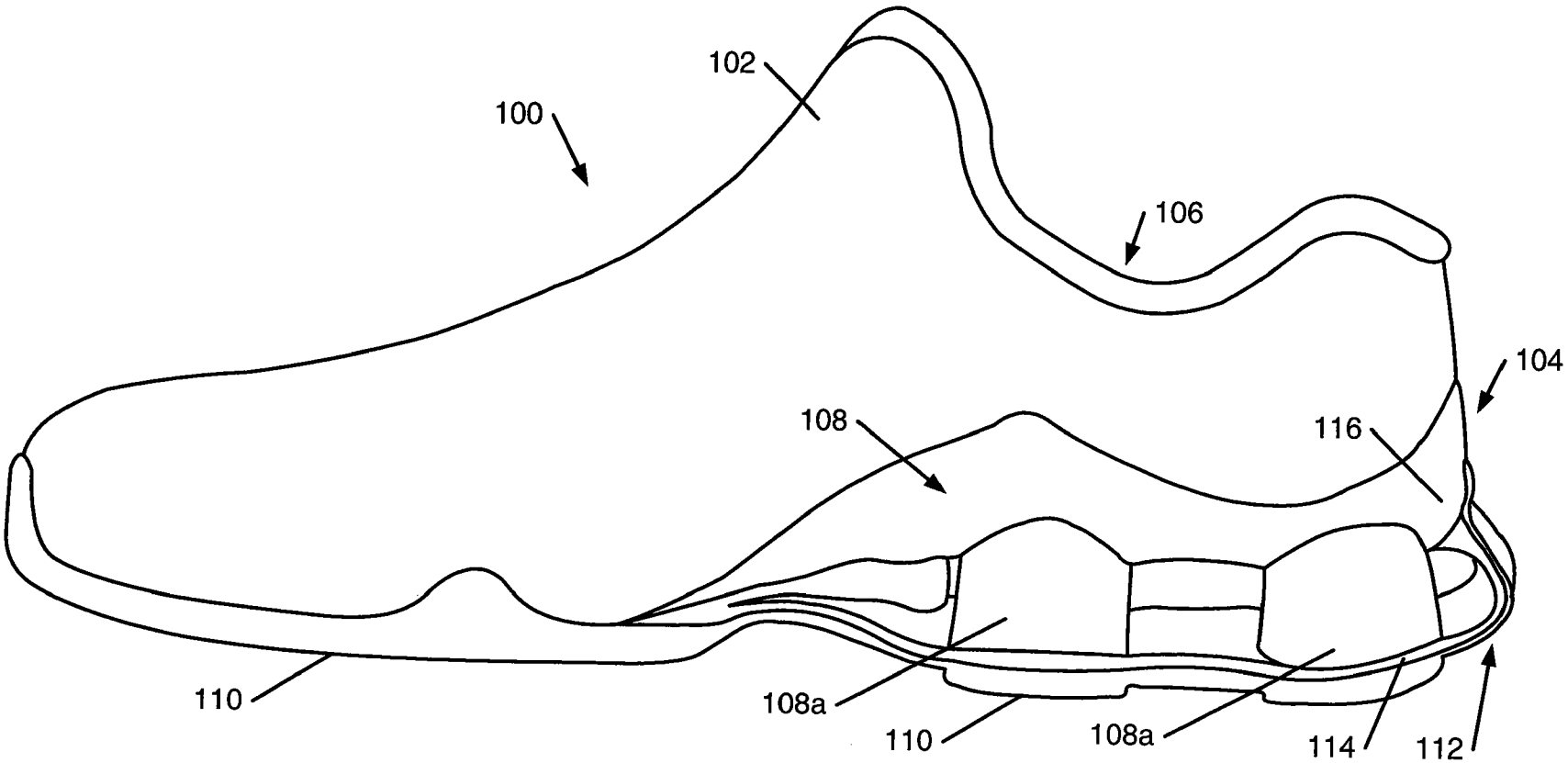
Fig. 1 (Prior Art)
FIG. 1 illustrates an example conventional article of footwear that includes plural impact-attenuating elements in a midsole structure located between an outsole and a shoe upper.

In the following description of various examples of the invention, reference is made to the accompanying drawings, which form a part hereof, and in which are shown by way of illustration various example systems and environments in which aspects of the invention may be practiced. It is to be understood that other specific arrangements of parts, example systems, and environments may be utilized and structural and functional modifications may be made without departing from the scope of the present invention. Also, while the terms "top," "bottom," "side," "front," "back," "above," "below," "under," "over," and the like may be used in this specification to describe various example features and elements of the invention, these terms are used herein as a matter of convenience, e.g., based on the example orientations shown in the figures and/or a typical orientation during use. Nothing in this specification should be construed as requiring a specific three dimensional orientation of structures in order to fall within the scope of this invention.

To assist the reader, this specification is broken into various subsections, as follows: Terms; General Description of Support Elements and Associated Products According to the Invention; Specific Examples of the Invention; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like. "Footwear" may protect the feet from the environment and/or enhance a wearer's performance (e.g., physically, physiologically, medically, etc.).

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Ground-contacting elements" or "members" include at least some portions of a foot-receiving device structure that contact the ground or any other surface in use, and/or at least some portions of a foot-receiving device structure that engage another element or structure in use. Such "ground-contacting elements" may include, for example, but are not limited to, outsole elements provided in some conventional footwear products. "Ground-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. General Description of Support Elements and Associated Products According to the Invention In general, aspects of this invention relate to support elements and products in which they are used (such as support elements for footwear or other foot-receiving device products, and the like). Support elements in accordance with at least some examples of this invention may provide enhanced support in the lateral and/or medial directions, e.g., additional support against shear, for example, when a user pushes off the side of his/her foot, when making cuts, changing directions, changing speeds, starting a run, etc. Support elements in accordance with at least some example aspects of this invention may include: (a) a base member having a first major surface and a second major surface opposite the first major surface; and (b) an arm extending from the base member, wherein a free end of the arm includes a footwear-engaging region for engaging a portion of a footwear structure (such as the footwear upper or sole structure). The arm may be defined or produced directly from the base member structure, e.g., by two parallel or substantially parallel cut lines that produce a strip of material forming the arm from the material making up the base member. In at least some examples, the arm will extend from the base member at an angle (e.g., bent at or near the base of the cut lines) over the first major surface of the base member. Also, more than one arm may be provided, optionally extending in different directions, without departing from this invention.

The base member of the support element may include structures that assist in engaging and maintaining the support element's location with respect to other structural elements, e.g., other structural elements in an article of footwear or other foot-receiving device structure. For example, either or both of the major surfaces of the base member may include raised engagement structures that fit into corresponding grooves or openings defined in another portion of a foot-receiving device structure (e.g., in the midsole or outsole structure). Alternatively, if desired, the base member may include grooves or openings that fit together with corresponding raised engagement elements provided in another portion of a foot-receiving device structure (e.g., in the midsole or outsole structures). Of course, other types of engagement structures or engagement devices may be used to help hold the various parts together without departing from the invention.

In addition to including a base member and at least one extending arm as described above, footwear support elements in accordance with at least some examples of this invention further may include an impact-attenuating member, wherein at least a portion of the first major surface of the base member is engaged with the impact-attenuating member. The impact-attenuating member, which may form at least a portion of a footwear sole structure (such as a midsole), may have an opening defined therein, and the extending arm of the support element may extend through this opening. In some examples, the impact-attenuating member may include one or more impact-attenuating elements (such as polymeric foam columns or other impact-attenuating material structures) integrally formed with and/or extending from a base of the impact-attenuating member. The base or other portion of the impact-attenuating member may include one or more grooves or openings defined therein, as described above, for engaging engagement structures in the support element (or vice versa) and/or maintaining the position of the base member with respect to the impact-attenuating element. As another example, if desired, the base of the impact-attenuating member and the base member of the support element may constitute a single, unitary element, in at least some examples of this invention.

Additional example aspects of this invention relate to foot-supporting members that include: (a) a heel-supporting member; (b) an impact-attenuating member engaged with the heel-supporting member; and (c) a lateral-reinforcing member engaged with or extending from the impact-attenuating member, wherein the lateral-reinforcing member includes an extending arm that engages the heel-supporting member. The lateral-reinforcing member may be arranged to help prevent lateral, sideways, or "shear" type movement of the heel-supporting member with respect to the impact-attenuating member (e.g., to either the lateral or medial sides of the foot). Such foot-supporting members further may include ground-contacting members (such as footwear outsole members) engaged with at least one of the impact-attenuating member or the lateral-reinforcing member. In at least some example structures in accordance with this aspect of the invention, the lateral-reinforcing member may be at least partially located between the impact-attenuating member and the ground-contacting member. In other examples, if desired, the lateral-reinforcing member may be integrally formed, as a unitary one-piece construction, with the impact-attenuating member or the ground-contacting member. The impact-attenuating member may take on any suitable or desired structures, including the various structures described above (e.g., with an opening defined therein through which the extending arm of the lateral-reinforcing member extends, with openings or grooves to engage raised ribs or other engagement portions of the lateral- reinforcing member, with one or more impact-attenuating columns or other elements, with a "tail" or loop heel extension, etc.) without departing from the invention. Also, foot-supporting members according to at least some examples of this invention may form at least a portion of a sole structure for an article of footwear.

Still additional example aspects of this invention relate to foot-receiving devices. Such devices may include, for example: (a) a foot-covering member; (b) a foot-supporting member engaged with the foot-covering member, wherein the foot-supporting member, at least in part, attenuates impact reaction forces; and (c) a lateral-reinforcing member, wherein the lateral-reinforcing member includes an extending arm that engages at least one of the foot-covering member or the foot-supporting member. The lateral-reinforcing member may constitute a portion of the foot-supporting member structure. Such foot-receiving devices further may include a ground-contacting member engaged with at least one of the foot-supporting member or the lateral-reinforcing member. As described above, the lateral-reinforcing member may be at least partially located between the foot-supporting member and the ground-contacting member and/or integrally formed as part of one of these members, and it may be arranged to help prevent lateral (sideways or shear) movement of the heel area of the foot-receiving device (e.g., to either the lateral or medial side of the foot). In at least some example structures according to the invention, at least some portion of the foot-supporting member may include an opening defined therein through which the extending arm of the lateral-reinforcing member may extend to engage at least one of the foot-covering member or the foot-supporting member.

The foot-covering member in at least some examples of this invention may form at least a portion of an upper member for an article of footwear, the foot-supporting member may form at least a portion of a sole structure, including a midsole structure, for the article of footwear, and the ground-contacting member may form at least a portion of an outsole member for the article of footwear. Various portions of the foot-receiving device structure may take on the structures of the members described above. If desired, in at least some examples of the invention, the extending arm of the lateral-reinforcing member may engage a side of a heel cup or heel counter portion of an article of footwear.

Specific examples and structures according to the invention are described in more detail below. The reader should understand that these specific examples and structures are set forth merely to illustrate the invention, and they should not be construed as limiting the invention.

C. Specific Examples of the Invention

The various figures in this application illustrate examples of support members and their arrangement in foot-receiving device products according to examples of this invention. When the same reference number appears in more than one drawing, that reference number is used consistently in this specification and the drawings to refer to the same or similar parts throughout.

Figure 2:
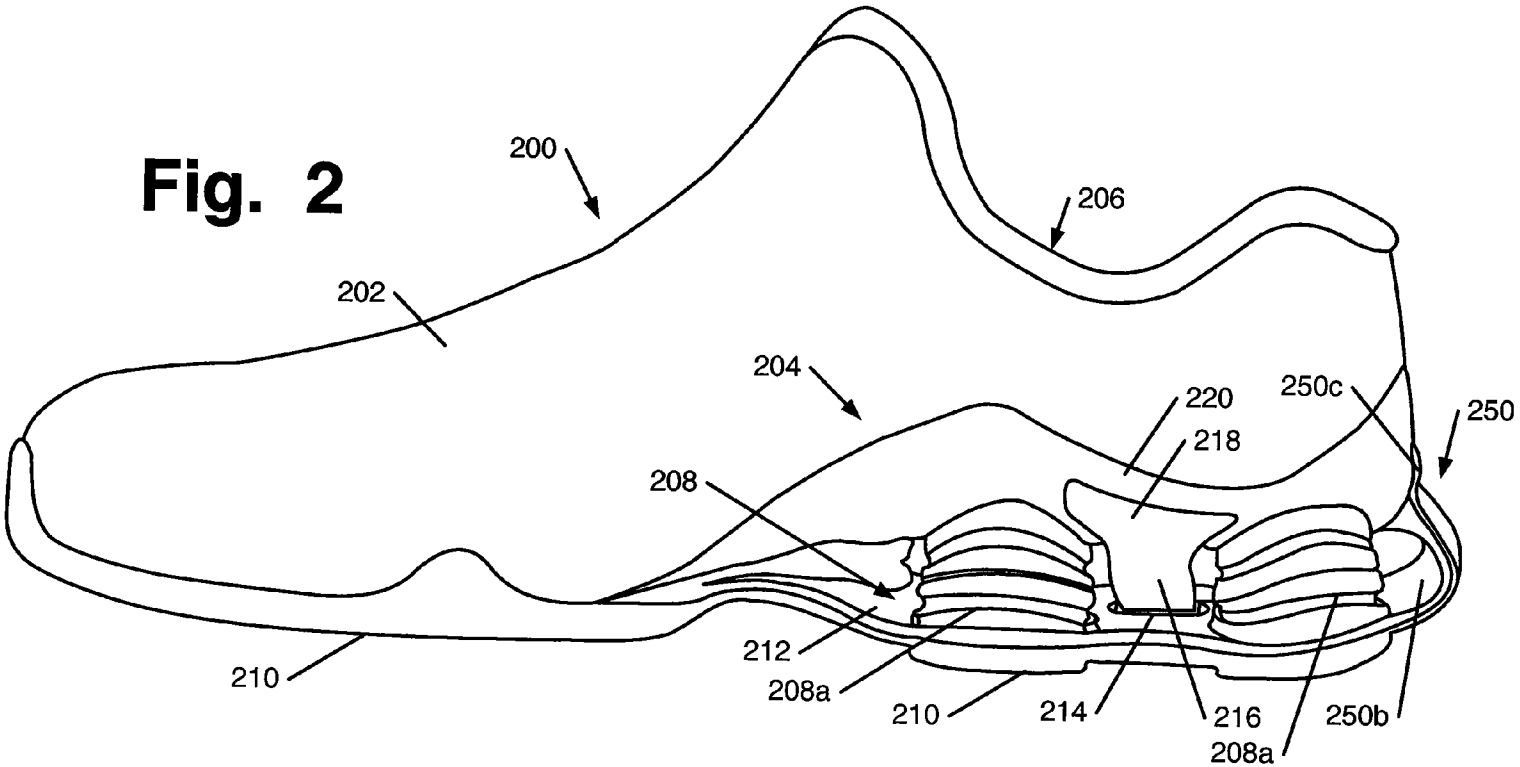
FIG. 2 illustrates an example footwear structure in which the sole structure includes an example support member in accordance with aspects of this invention.

FIG. 2 illustrates an example footwear structure 200 in accordance with at least some examples of this invention. As shown, this example footwear structure 200 includes an upper member 202 (or other foot-covering member) with a sole structure 204 connected to it. The upper member 202 and sole structure 204 may be connected to one another in any suitable or desired manner, including in conventional manners known and used in the art, such as via adhesives or cements, via stitching or sewing, mechanical connectors, fusing techniques, or the like. As is also conventional, the upper member 202 and the sole structure 204 together, at least in part, may form a foot-receiving chamber into which a wearer's foot may be inserted, e.g., via opening 206. Also, as is conventional, the sole structure 204 may be formed from a comfort-enhancing insole (not shown in FIG. 2), a resilient midsole member 208 (e.g., formed, at least in part, from a polymer foam material, as described above), and a ground-contacting outsole member 210 that may provide both abrasion-resistance and traction. The footwear structure 200 (or other foot-receiving device structure) further may include one or more closure elements or systems of any suitable or desired type without departing from the invention, including conventional closure elements and/or systems known and used in the art. Examples of such systems include: laces, zippers, buckles, hook-and-loop fasteners, etc. In at least some examples of this invention, the footwear structure 200 may constitute an article of athletic footwear.

If desired, as shown in FIG. 2, the midsole member 208 may be of an open structure, such that columns of impact-attenuating elements 208*a* are exposed and visible in the final footwear structure 200. Indeed, in this illustrated structure 200, one can see completely through the midsole structure 208 to the opposite side of the footwear structure 200 and beyond. Of course, if desired, the midsole member 208 may be completely enclosed and/or filled with (or substantially filled with) impact-attenuating materials (such as polymeric foam materials as described above) or other suitable or desired materials.

As further shown in FIG. 2, a base portion 212 of the midsole member 208 (or other impact-attenuating member) includes an opening 214 defined therein. A support arm 216, which will be described in more detail below, extends from beneath the base portion 212 and through the opening 214. The free end of this support arm 216 includes a footwear-engaging region 218 that engages another portion of the footwear structure 200, such as the upper member 202 or another portion of the sole member 204. In this illustrated example, the footwear-engaging region 218 of support arm 216 contacts and holds a heel-supporting portion 220, which optionally forms part of the midsole member 208. This heel-supporting portion 220 may constitute a structural plate, such as plates of the type used in conventional footwear products, e.g., plates to which impact-attenuating elements 208*a* of the type used in NIKE SHOX™ products typically attach. As some more specific examples, this heel-supporting portion 220 may be made of PEBAX® (e.g., PEBAX® 7233 (PEBAX® is a polyether-block co-polyamide polymer available from Atofina Corporation of Puteaux, France)), other plastics, or other structural materials, including materials used in conventional footwear structures. Alternatively, if desired, the footwear-engaging region 218 may connect with and hold a heel cup or heel counter portion of the footwear structure 200 and/or the footwear upper member 202. In the illustrated example, the support arm 216 and the footwear-engaging region 218 extend to and are located at the outside part of the footwear structure 200 (to the lateral side of the footwear structure), although such support arm structures 216 and footwear-engaging regions 218 may be provided on either or both of the lateral and medial sides of the footwear structure 200 without departing from this invention (unless otherwise noted or clear from the context, the term "lateral," as used herein, is intended to generically refer to either or both of the lateral and/or medial sides of the foot and/or foot-receiving device products). Additionally, or alternatively, if desired, such support arm structures 216 and footwear-engaging regions 218 may be provided at the back heel or other portions of the footwear structure 200 without departing from this invention. Of course, if desired, one or more support arms, running in various different directions (e.g., from bottom medial to top lateral, from top lateral to bottom medial, from bottom lateral to top medial, from top medial to bottom lateral, etc.) may be provided without departing from the invention.

In use, the fixed connection between the footwear-engaging region 218 and the heel-supporting portion 220 (or other portion) of the footwear structure 200 (e.g., via adhesives, cements, mechanical connectors, fusing techniques, or the like), as well as the relatively rigid character (e.g., non-stretching) of support arm 216 (as will be described in more detail below), help prevent lateral, sideways, or shear movement of the heel-supporting member 220 with respect to the remainder of the sole structure 204 (e.g., with respect to impact-attenuating elements 208*a*, base member 212, and/or outsole member 210).

Figure 3:
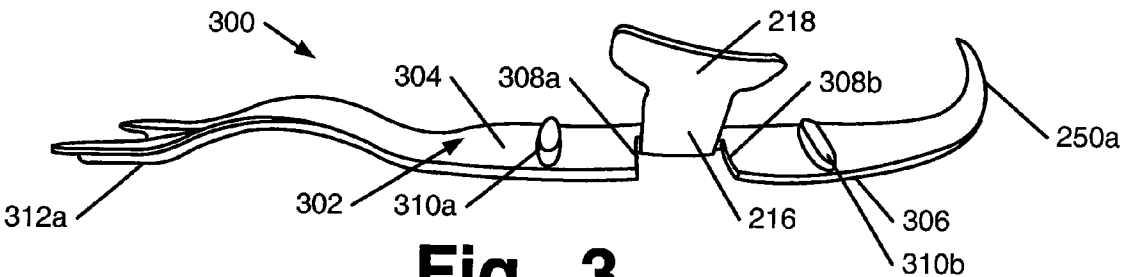
FIG. 3 illustrates a side perspective view of an example support member in accordance with aspects of this invention.
Figure 4:
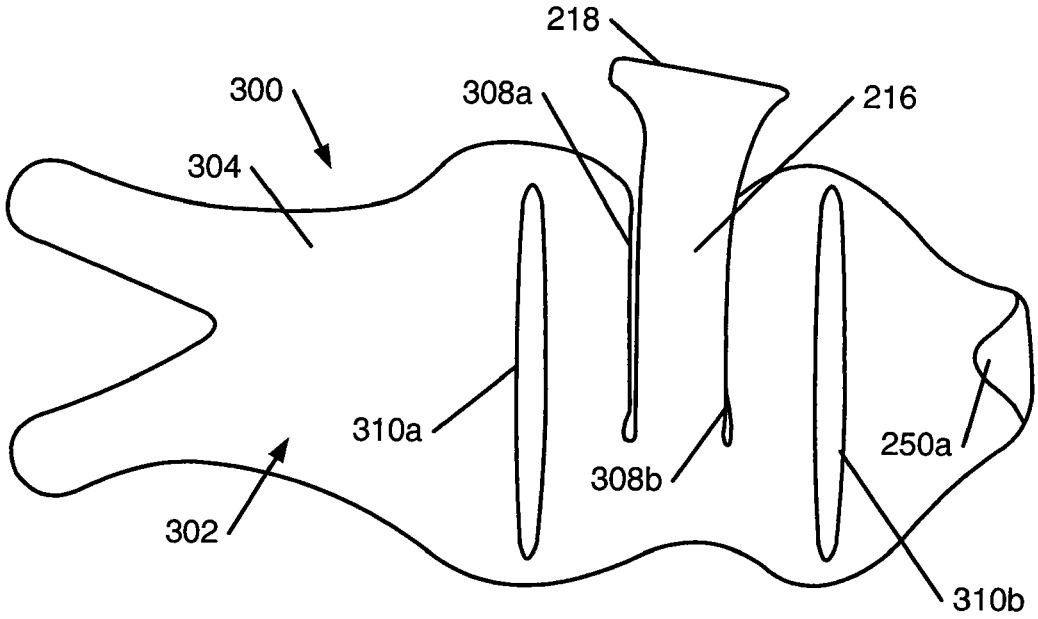
FIG. 4 illustrates an overhead view of an example support member in accordance with aspects of this invention.
Figure 5:
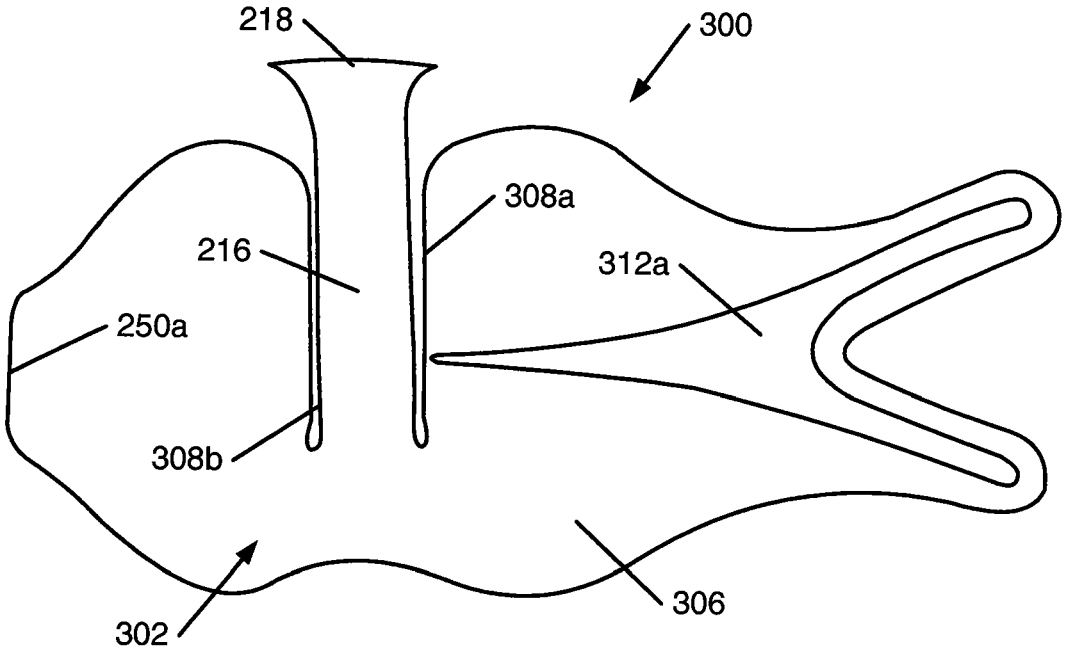
FIG. 5 illustrates an underside view of an example support member in accordance with aspects of this invention.

FIGS. 3 through 5 illustrate an example support member 300, including a support arm 216 and footwear-engaging free end region 218 as described above in the discussion of FIG. 2 (FIG. 3 is a side perspective view, FIG. 4 is an overhead view, and FIG. 5 is an underside view of the support member 300). As shown in FIG. 3, the support element 300 may include a base member 302 that has a first major surface 304 and a second major surface 306 opposite the first major surface 304. The support arm 216 extends from the base member 302 such that its free end (including the footwear-engaging region 218) is available for engaging another portion of a footwear structure. The support arm 216 may be formed directly from a portion of the base member 302 structure, e.g., by cutting two parallel (or substantially parallel) lines 308*a* and 308*b* in the material making up the base member 302. If desired, the material of the base member 302 may be bent, e.g., at or near the base of the cut lines 308*a* and 308*b*, such that the support arm 216 and the footwear-engaging free end region 218 extend upward from the base member 302 at an angle over the first major surface 304.

The first major surface 304 of this example support member 300 further includes a pair of raised elements 310*a* and 310*b*. These raised elements 310*a* and 310*b*, in this example structure 300, act as engagement structures to help maintain the support member 300 in place in foot-receiving device (or other) structure. In this illustrated example, as can be seen in more detail in FIG. 7, the raised elements 310*a* and 310*b* fit into slots formed in another portion of the foot-receiving device structure (e.g., in a base of a footwear midsole structure in this example), to help hold the support member 300 in place with respect to an impact-attenuating portion of the midsole structure. The content of FIG. 7 will be described in more detail below. The second major surface 306 of the support member 300 also may include one or more raised elements 312*a* that act as engagement structures to help maintain the support member 300 in place with respect to other portions of a foot-receiving device structure. As illustrated in connection with FIG. 9 (which also is described in more detail below), the raised element 312*a* helps hold the support member 300 in place with respect to an outsole portion of a footwear sole structure. Of course, any number of raised elements 310*a*, 310*b*, and/or 312*a* may be included in a support member structure 300, and these elements may be of any desired shape, arrangement, or construction without departing from the invention. Moreover, such raised elements 310*a*, 310*b*, and/or 312*a* may be included in the support member structure 300 in any desired manner without departing from the invention, such as via adhesives or cements, by mechanical connections, by being integrally formed with the support member 300 structure, e.g., during molding (e.g., injection molding or the like), etc. As an alternative, if desired, the support member 300, including the extending arm 216 and the footwear-engaging region 218, may be integrally formed, as a unitary one-piece construction, with a portion of the sole member, such as with part of the midsole base portion 212 or the outsole member 210.

The support member 300 also may be made from any suitable or desired type of material without departing from the invention, including materials conventionally used in base plates for sole structures and/or other portions of footwear products. As more specific examples, the support member 300 may be made from metal, polymeric, or other materials, e.g., materials that have limited tensile stretch or give characteristics under typical footwear use conditions. A support member material useful in at least some examples of this invention includes PEBAX® (a polyether-block co-polyamide polymer available from Atofina Corporation of Puteaux, France). In some examples, the support member 300 (including the various raised engagement elements 310*a*, 310*b*, and 312*a* (if any), the extending arm 216, and the footwear-engaging region 218) will be integrally formed as a unitary, one-piece construction, e.g., by molding, such as by injection, compression, or blow molding processes. Of course, other ways of producing the support member 300, and indeed a wide variety of support member constructions and structures, may be used without departing from this invention.

Figure 6:
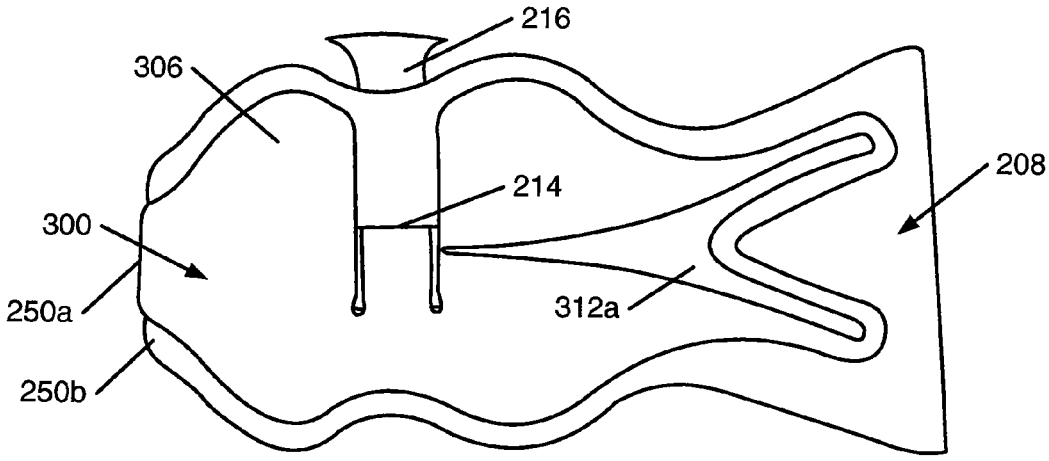
FIG. 6 illustrates an underside view of an example support member joined with an example impact-attenuating member in accordance with aspects of this invention.
Figure 7:
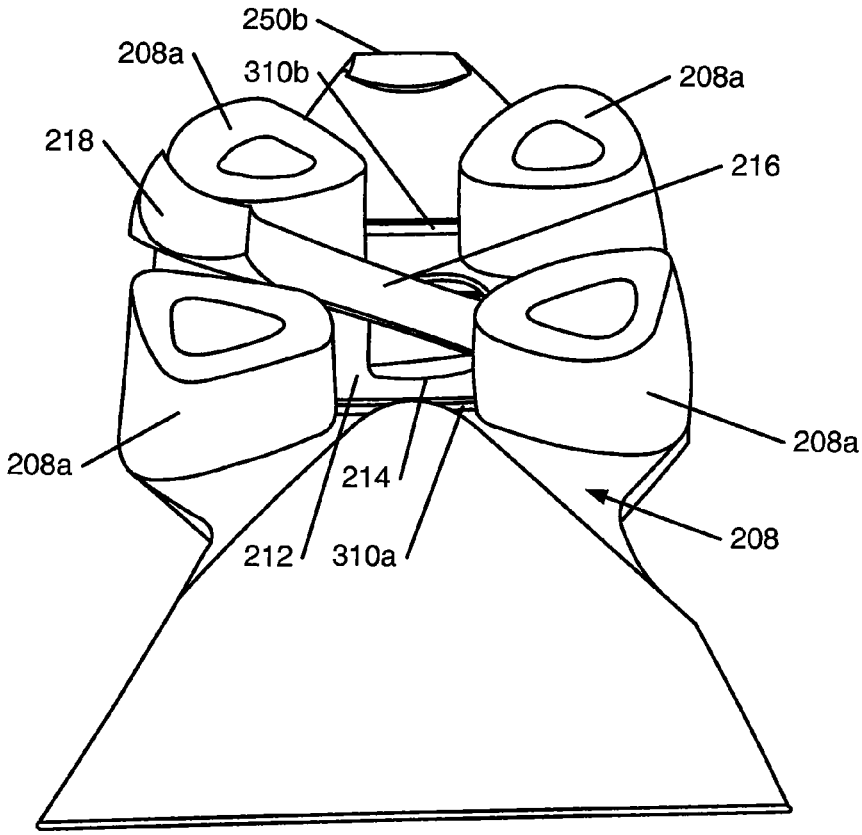
FIG. 7 illustrates another view of an example support member joined with an example impact-attenuating member in accordance with aspects of this invention.

FIGS. 6 and 7 illustrate the example support member 300 of FIGS. 3-5 connected with an impact-attenuating member 208 that forms at least a portion of a midsole for an article of footwear. As shown in FIG. 6, the first major surface 304 of the support member 300 (not shown in FIG. 6) is engaged with an underside surface of the impact-attenuating member 208 such that the second major surface 306 of the support member 300 remains exposed. As described above, the impact-attenuating member 208 of this example structure includes an opening 214 defined in its base portion 212, and the extending support arm 216 of the support member 300 extends through this opening 214 to the top side of the impact-attenuating member 208. If desired, in at least some impact-attenuating member structures 208, plural independent impact-attenuating elements 208*a* may be provided. Four individual impact-attenuating columns 208*a*, integrally formed as a one-piece unitary construction with the remainder of the impact-attenuating element structure 208 (e.g., by molding), are shown in the example structure 208 in FIG. 7. If desired, in at least some examples, an additional arm support member, such as polymer foam material, may be provided beneath the arm 216 and between the arm 216 and the base portion 212 of impact-attenuating member 208, to further support the arm 216.

The impact-attenuating member 208, as well as the various individual impact-attenuating elements 208*a*, may be made from any suitable or desired materials without departing from the invention, including from conventional midsole materials or other materials known and used in the art. Examples of suitable materials include polymer foam materials, such as ethylvinylacetate or polyurethane foam materials or other materials that compress resiliently under an applied load to attenuate ground reaction forces. Also, if desired, the impact-attenuating elements 208*a* may be made from different materials or materials having different characteristics from those making up other portions of the impact-attenuating member structure 208 (such as the base portion 212). Also, if desired, in at least some examples of the invention, the impact-attenuating elements 208*a* may be made from and/or include mechanical devices that help attenuate ground reaction forces, such as springs, hydraulic members, pistons, or the like. In at least some examples, this impact-attenuating portion 208 of the footwear midsole structure may be constructed such that an open area is defined in the midsole structure, and one or impact-attenuating elements 208*a* may be included and visible in this open area. In at least some example footwear structures, e.g., like structure 200 shown in FIG. 2, the open area will remain open and exposed in the final footwear or other foot-receiving device product, e.g., without immediately surrounding foam, midsole structure, or other structural elements, akin to products commercially available from NIKE, Inc. under the trademark SHOX™. The impact-attenuating member 208 and the impact-attenuating elements 208*a* may be made from materials conventionally used in NIKE SHOX™ products, if desired. In still other examples, the impact-attenuating portion 208 (and any present impact-attenuating elements 208*a*) may be at least partially enclosed and/or surrounded by other materials (such as foam material) and not visible or accessible in the final footwear product without departing from this invention.

The support member 300 may be fixed to the impact-attenuating member structure 208 in any desired manner without departing from this invention. For example, adhesives or cements may be used to adhere the first major surface 304 of the support member 300 to the underside of the impact-attenuating member 208. Also, as generally described above, the first major surface 304 of the support member 300 may include one or more raised engagement elements (e.g., raised elements 310*a* and 310*b*) that fit into corresponding grooves or openings provided in the impact-attenuating member 208. FIG. 7 illustrates the tops of engagement elements 310*a* and 310*b* extending upward through corresponding openings provided in the impact-attenuating member structure 208. The engagement elements 310*a* and 310*b*, when fit into corresponding grooves or openings provided in the impact-attenuating element structure 208, can help position and prevent undesired movement of support member 300 with respect to the impact-attenuating member 208. In the illustrated example, engagement elements 310*a* and 310*b* are provided on opposite sides of the opening 214 through which the extending arm 216 extends. Of course, any desired number, shape, arrangement, or construction of engagement elements in the support member and corresponding openings or grooves in the impact-attenuating element structure (or vice versa) may be provided without departing from this invention. Also, if desired, each of the support member and the impact-attenuating member may contain combinations of raised engagement element, openings, and/or grooves without departing from the invention. As still another example, if desired, the support member 300 may be integrally formed, as a unitary one-piece construction, with the impact-attenuating member 208 (e.g., it may form a least some of base portion 212).

Figure 8:
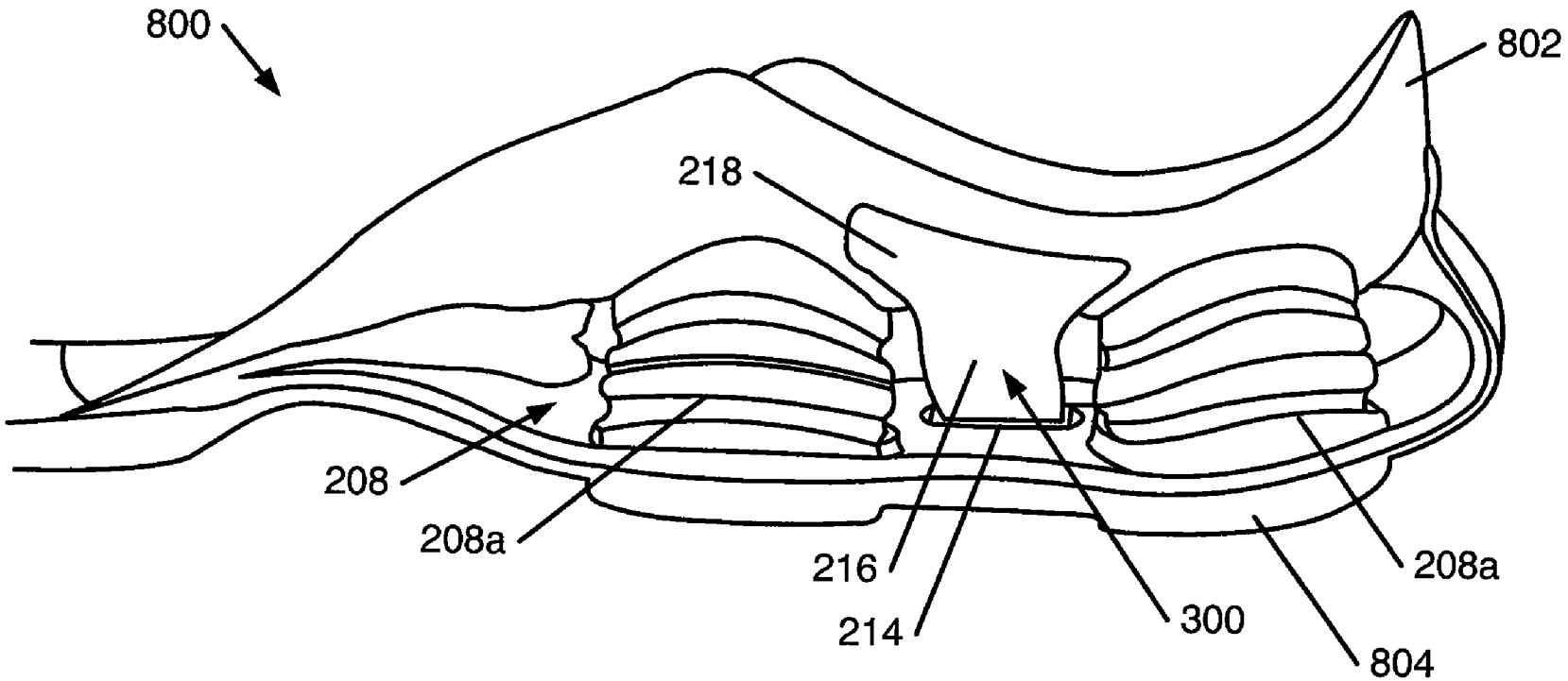
FIG. 8 illustrates a side view of a portion of an example sole structure according to aspects of this invention in which a support member is included in the sole structure.

FIG. 8 illustrates a portion of a footwear sole structure 800 in accordance with an example of this invention. In this example sole structure 800, an impact-attenuating member 208, including a support member 300 (with support arm 216) is provided as generally described above in conjunction with FIGS. 6 and 7. The sole structure 800 of this example further includes a heel-supporting member 802 that lies above and is supported by impact-attenuating elements 208*a*. The heel-supporting member 802 provides a surface for supporting a footwear insole, the wearer's heel, and/or a portion of an upper member structure at the heel area of an article of footwear. In this example structure 800, the footwear-engaging region 218 of the extending arm 216 engages with a side of the heel-supporting member 802. If desired, the heel-supporting member 802 may constitute a portion of an upper member of a footwear structure, a heel cup, a heel counter, or the like, without departing from the invention.

The footwear-engaging region 218 of the extending arm 216 may be engaged with the heel-supporting member 802 in any desired manner without departing from this invention. For example, adhesives or cements may be used to fix these elements together. As another example, mechanical connectors, such as rivets, nuts and bolts, retaining edges, or the like may be used without departing from the invention. Fusing techniques also may be used to fix these elements together. Of course, any number of extending arms 216 and/or engaging regions 218 may be provided, and such members may be located and engaged with the heel-supporting member 802 (or other portion of the footwear structure) at any desired position(s) without departing from this invention. In at least some examples of the invention, the heel-supporting member 802 will be made from a polymeric material (such as PEBAX® polymers available from Atofina Corp.) capable of engaging with and bonding to the material of the foot-engaging region 218 (also a polymeric material) using a suitable cement or adhesive. The extending arm 216 and/or engaging region 218 also may take on any shape or width without departing from the invention.

The example sole structure 800 of FIG. 8 further includes an outsole member 804 (or other ground-contacting member). As generally illustrated in FIG. 8, the lateral support member 300 in this example structure 800 is sandwiched between the outsole member 804 and the impact-attenuating member 208, wherein the extending arm 216 of the support member 300 extends toward the heel-supporting member 802 through the opening 214 provided in the impact-attenuating member 208. The outsole member 804, the impact-attenuating member 208, and/or the support member 300 may be engaged together in any desired manner without departing from the invention, including via cements or adhesives, sewing or stitching, mechanical connectors, retaining element structures, fusing techniques, and/or any other way, including in conventional ways known and used in the art. Of course, the outsole member 804 may be made from multiple independent parts or pieces, and the various parts or pieces may include various different tread designs, traction elements, and/or other conventional structural or design elements without departing from this invention. Also, if desired, the support member 300 may be integrally formed as part of at least some portion of the outsole member (e.g., as a unitary, one-piece construction), without departing from the invention.

Figure 9:
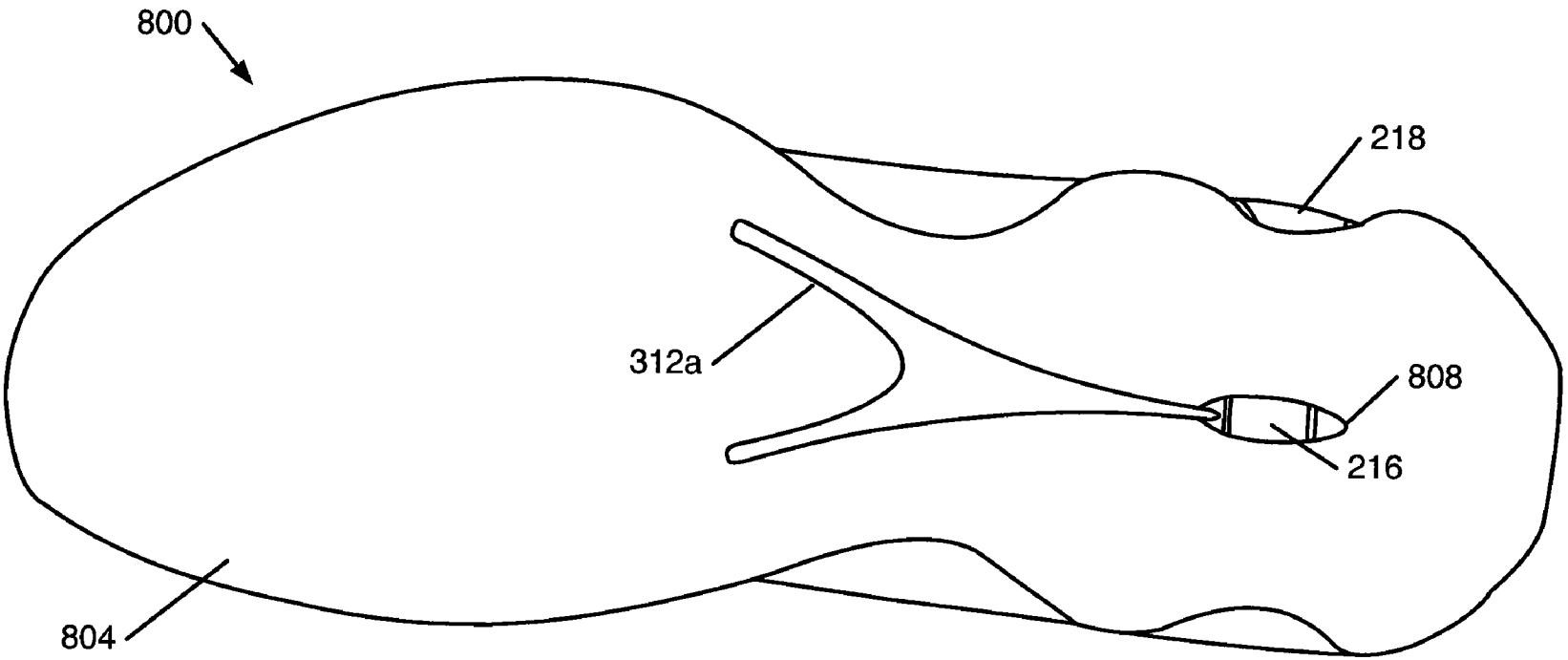
FIG. 9 illustrates an underside view of a portion of an example sole structure according to aspects of this invention in which a support member is included in the sole structure.

When provided as separate elements, the support member 300 may include structures to help firmly engage it with the remainder of the sole structure 800. For example, the support member 300 may include raised engagement portion 312*a* on its second major surface 306 (see FIGS. 5 and 6) that fits into a corresponding opening or groove provided in the outsole member 804 (or other ground-contacting member structure). FIG. 9 illustrates an example structure in which the raised engagement portion 312*a* snuggly fit within a corresponding opening provided in the outsole member 804. This arrangement helps prevent movement of the support member 300 with respect to the outsole member 804 and provides an interesting visual appearance (e.g., because, in this example structure, the raised engagement portion 312*a* is visible through an open area 808 defined in the outsole member 804). Of course, any desired number, shape, arrangement, or construction of engagement elements on the support member 300 and corresponding openings or grooves that engage in the outsole member 804 (or vice versa) may be used without departing from this invention. Also, if desired, each of the support member 300 and the outsole member 804 may include combinations of engagement elements, openings, and/or grooves that engage corresponding elements, openings, and/or grooves on the other member without departing from this invention. FIG. 9 further illustrates that a portion of the extending arm 216 is visible through the open area 808, which also provides an interesting visual appearance for the sole structure 800.

Of course, if desired, the outsole member 804 may be constructed without openings such that the raised engagement portion 312*a*, the strap member 216, and/or the opening 214 in the impact-attenuating member structure 208 are not visible through the bottom of the footwear sole structure 800. As further alternatives, if desired, one or all of the raised engagement portions 310*a*, 310*b*, 312*a*, or the like may be omitted from at least some footwear structures without departing from the invention (e.g., adhesives, cements, or other engagement systems as described above may hold the support member 300 in place without using additional raised engagement structures).

Returning now to FIG. 2, as described above, an example article of footwear 200 (or other foot-receiving device structure) in accordance with this invention is illustrated. Specifically, this example article of footwear 200 (or other foot-receiving device structure) includes the upper member 202 (or other foot-covering member) and a foot-supporting member 204 (or other sole structure) engaged together. The footwear structure 200 further includes a lateral-reinforcing member in the form of the support member 300, which includes the extending arm 216 that engages at least one of the upper member 202 or the sole structure 204. The fixed relationship of the footwear-engaging region 218 of the extending arm 216 with respect to the upper member 202 and/or the sole structure 204 and the fixed relationship of the support member 300 with the impact-attenuating member structure 208 help prevent the heel portion of the upper member 202 or the sole structure 204 from moving laterally with respect to the impact-attenuating member 208 and/or the remainder of the footwear sole structure 204 (e.g., helps resist shear forces). Therefore, when a person wearing an article of footwear 200 equipped with support element 300 plants his/her foot and pushes off in a sideways manner (e.g., in order to make a cut or quickly change directions), the footwear-engaging region 218 and the extending arm 216 (non-stretching) will help hold the heel-supporting portion 802 and/or the upper member 202 in place with respect to the planted sole member 204, prevent shear displacement of these elements with respect to one another, and provide better foot support for the direction change action.

As noted throughout the above description, many variations in the support member structure, the foot-supporting member structure (e.g., the sole structure), and/or the foot-receiving device structure (e.g., an article of footwear) are possible without departing from this invention. For example, rather than providing an independent support member 300, the support member (and its extending arm 216 and footwear-engaging region 218) may be formed as a unitary, one-piece construction with other parts of the foot-receiving device product, such as part of the ground-contacting member, the foot-supporting member, etc. Also, multiple extending arms 216 and/or footwear-engaging areas 218 and/or a single, wide extending arm portion 216 and/or a single, wide footwear-engaging area 218 may be provided without departing from the invention. Indeed, if desired, the extending arm 216 and/or footwear-engaging area 218 may be as wide as or substantially as wide as the longitudinal length of the heel area of the foot-receiving device (e.g., extending or substantially extending the rear one-third of the entire foot-receiving device structure, or even further).

Also, the illustrated example footwear structure 200 of FIG. 2 includes a "tail" or loop portion 250 (e.g., formed from a tail portion 250*a* of the base member 300, a tail portion 250*b* of the impact-attenuating member 208, and a tail portion 250*c* of the outsole member 210). Such a tail or loop portion, e.g., extending from the outsole and/or midsole to an upper member and/or a heel-supporting member, can further improve the shear resistance characteristics of footwear and foot-receiving device structures in accordance with some examples of this invention. If desired, however, in accordance with at least some example structures according to the invention, this tail or loop portion 250 may be omitted from the shoe structure 200, and the overall footwear structure still may possess adequate shear resistance properties (e.g., for at least for certain activities or uses, depending on the construction of the support arm 216 and/or the footwear-engaging region 218, depending on other features of the midsole structure (such as the column 208*a* stiffnesses, compositions, structures, arrangements, etc,), or the like). For uses or users requiring additional or high levels of shear support, both the support arm 216 and the tail or loop 250 may be used, if desired.

D. Conclusion

While the invention has been described with respect to specific examples including presently preferred modes of carrying out the invention, those skilled in the art will appreciate that there are numerous variations, combinations, and permutations of the above described systems and methods. Moreover, various specific structural features included in the examples merely represent examples of structural features that may be included in some examples of structures according to the invention. Those skilled in the art will understand that various specific structural features may be omitted and/or modified in a footwear or other foot-receiving device product without departing from the invention. Thus, the reader should understand that the spirit and scope of the invention should be construed broadly as set forth in the appended claims.

We claim:

1. A footwear support element, comprising:

a base member including a first major surface and a second major surface opposite the first major surface, wherein the base member includes a first raised engagement structure extending from the first major surface;

an extending arm extending from the base member, wherein a free end of the extending arm includes a footwear-engaging region for engaging a portion of a footwear structure; and an impact-attenuating member including an opening defined therein, wherein at least a portion of the first major surface of the base member is engaged with the impact-attenuating member;

wherein the extending arm extends through the opening, and wherein the first raised engagement structure extends into a first groove or opening defined in the impact-attenuating member.

2. A footwear support element according to claim 1, wherein the base member includes a second raised engagement structure extending from the first major surface, wherein the second raised engagement structure extends into a second groove or opening defined in the impact-attenuating member, and wherein the first groove or opening is provided on a first side of the opening through which the extending arm extends and the second groove or opening is provided on a second side of the opening through which the extending arm extends.

3. A footwear support element according to claim 1, wherein the impact-attenuating member forms at least a portion of a footwear midsole structure.

4. A footwear support element according to claim 1, further comprising a heel-supporting member engaged with the impact-attenuating member.

5. A footwear support element according to claim 4, wherein the footwear engaging region of the extending arm engages the heel-supporting member.

6. A foot-supporting member, comprising:

a heel-supporting member;

an impact-attenuating member; and a lateral-reinforcing member engaged with or extending from the impact-attenuating member, wherein the lateral-reinforcing member includes an extending arm that engages the heel-supporting member;

wherein the impact-attenuating member includes an opening defined therein, wherein the extending arm of the lateral-reinforcing member extends through the opening to the heel-supporting member.

7. A foot-supporting member according to claim 6, wherein the impact-attenuating member forms at least a portion of a midsole member for an article of footwear.

8. A foot-supporting member according to claim 6, wherein the lateral-reinforcing member is integrally formed with the impact-attenuating member as a one-piece construction.

9. A foot-supporting member according to claim 6, wherein the extending arm extends in a direction from a lower medial side of the foot-supporting member toward an upper lateral side of the foot-supporting member, and the extending arm engages a lateral side of the heel-supporting member.

10. A foot-supporting member according to claim 6, wherein the extending arm extends in a direction from a lower lateral side of the foot-supporting member toward an upper medial side of the foot-supporting member, and the extending arm engages a medial side of the heel-supporting member.

11. A foot-supporting member, comprising:

a heel-supporting member;

an impact-attenuating member engaged with the heel-supporting member, wherein the impact-attenuating member includes a first surface and a plurality of first impact-attenuating elements extending from the first surface toward the heel-supporting member; and a lateral-reinforcing member engaged with or extending from the impact-attenuating member, wherein the lateral-reinforcing member includes an extending arm that engages the heel-supporting member;

wherein the impact-attenuating member includes an opening defined therein, wherein the extending arm of the lateral-reinforcing member extends through the opening, between two adjacent impact-attenuating elements, to the heel-supporting member.

12. A foot-supporting member according to claim 11, wherein the impact-attenuating member forms at least a portion of a midsole member for an article of footwear.

13. A foot-supporting member according to claim 11, wherein the lateral-reinforcing member is integrally formed with the impact-attenuating member as a one-piece construction.

14. A foot-supporting member according to claim 11, wherein the extending arm extends in a direction from a lower medial side of the foot-supporting member toward an upper lateral side of the foot-supporting member, and the extending arm engages a lateral side of the heel-supporting member.

15. A foot-supporting member according to claim 11, wherein the extending arm extends in a direction from a lower lateral side of the foot-supporting member toward an upper medial side of the foot-supporting member, and the extending arm engages a medial side of the heel-supporting member.

16. A foot-receiving device, comprising:

a foot-covering member;

a foot-supporting member engaged with the foot-covering member, wherein the foot-supporting member, at least in part, attenuates impact reaction forces, wherein the foot-supporting member includes a first surface and a plurality of first impact-attenuating elements extending from the first surface toward the foot-covering member; and a lateral-reinforcing member including an extending arm that engages at least one of the foot-covering member or the foot-supporting member;

wherein the foot-supporting member includes an opening defined therein, and wherein the extending arm of the lateral-reinforcing member extends through the opening, between two adjacent first impact-attenuating elements, to at least one of the foot-covering member or the foot-supporting member.

* * * * *